United States Patent [19]

Mahabadi et al.

[11] Patent Number: 4,543,313

[45] Date of Patent: Sep. 24, 1985

[54] TONER COMPOSITIONS CONTAINING THERMOTROPIC LIQUID CRYSTALLINE POLYMERS

[75] Inventors: Hadi-Khan Mahabadi, Mississauga; Lupu Alexandru, Toronto, both of Canada

[73] Assignee: Xerox Corporation, Stamford, Conn.

[21] Appl. No.: 637,188

[22] Filed: Aug. 2, 1984

[51] Int. Cl.[4] ..... G03G 9/10

[52] U.S. Cl. ..... 430/109; 430/110; 528/194

[58] Field of Search ..... 430/109, 110, 137; 528/194

[56] References Cited

U.S. PATENT DOCUMENTS

| | | | |
|---|---|---|---|
| 2,946,766 | 7/1960 | Schnell et al. | 260/47 |
| 3,112,292 | 11/1963 | Bottenbruch et al. | 260/47 |
| 3,161,615 | 12/1964 | Goldberg | 260/47 |
| 3,193,528 | 7/1965 | Miller et al. | 260/47 |
| 3,269,985 | 8/1966 | Loncrini | 260/47 |
| 3,312,660 | 4/1967 | Kurkjy et al. | 260/47 |
| 3,312,661 | 4/1967 | Kurkjy et al. | 260/47 |
| 3,312,662 | 4/1967 | Kurkjy et al. | 260/47 |
| 3,428,600 | 2/1969 | Sullivan et al. | 260/47 |
| 4,153,779 | 5/1979 | Jackson et al. | 528/194 |
| 4,242,496 | 12/1980 | Jackson et al. | 528/194 |
| 4,281,101 | 7/1981 | Schreckenberg et al. | 528/196 |
| 4,371,660 | 2/1983 | Calundann et al. | 528/190 |

*Primary Examiner*—John L. Goodrow

*Attorney, Agent, or Firm*—E. O. Palazzo

[57] ABSTRACT

Disclosed are improved toner compositions comprised of resin particles selected from the group consisting of thermotropic liquid crystalline polycarbonates, copolycarbonates, polyurethanes, polyesters, and copolyesters, and pigment particles.

28 Claims, 2 Drawing Figures

TONER COMPOSITIONS CONTAINING THERMOTROPIC LIQUID CRYSTALLINE POLYMERS

BACKGROUND

Figure 1A:
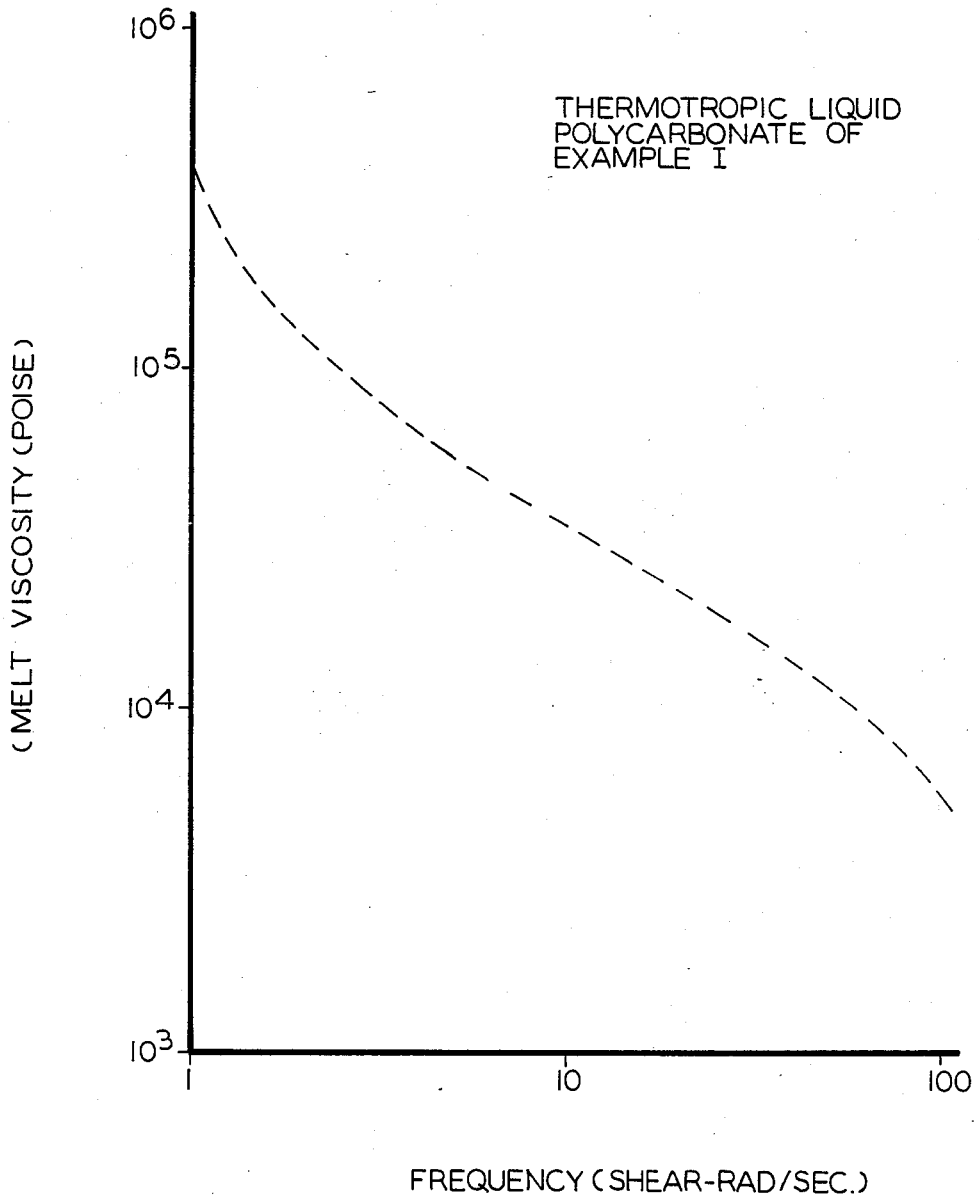

This invention is generally directed to electrophotography, and more specifically the present invention relates to toner and developer compositions for use in electrostatic imaging systems. In one embodiment the present invention is directed to thermotropic liquid crystalline polymers which are useful as toner compositions. These polymers are of a chemical structure enabling their melting over a narrow temperature interval wherein there is a substantial decrease in the melt viscosity at a clearing temperature which is above the melting point of the toner resin. Toner compositions having incorporated therein the thermotropic liquid crystalline polymers possess excellent flow properties, and desirable paper wetting characteristics; and moreover these toner compositions are highly useful in electrostatic imaging systems, wherein flash fusing processes are selected for enabling the adherence of the developed toner image to a supporting substrate such as paper. Additionally, toner and developer compositions with the thermotropic liquid crystalline polymers have other desirable characteristics including, for example, providing markings of high optical density and allowing matte finishes subsequent to flash fusing processing.

The development of electrostatic latent images with toner compositions comprised of a blend of toner resin particles and pigment particles is well known. Recently, there have been disclosed developer compositions with charge enhancing additives which impart negative charges, or positive charges to the toner resin particles. For example, there is disclosed in U.S. Pat. No. 4,298,672 positively charged toner compositions comprised of resin particles, and pigment particles, and as a charge enhancing additive pyridinium compounds and their hydrates of the formula as detailed in column 3, beginning at line 14. Additionally, there is disclosed in U.S. Pat. No. 4,338,390 positively charged developer compositions containing as charge enhancing additives organic sulfate, and sulfonate compositions. Illustrative examples of toner resin particles disclosed in these patents include numerous known resin compositions, such as styrene butadiene resin copolymers, styrene methacrylate copolymers, polyesters, and polyurethanes. Further, there is illustrated in U.S. Pat. No. 3,326,848 a toner composition with styrene butadiene copolymer resins, and the use of this composition for developing positively charged latent electrostatic images. Also, there is described in U.S. Pat. No. 3,960,737 a liquid developer composition containing a mixture of styrene butadiene copolymer resins and an acrylate. Moreover, disclosed in U.S. Pat. No. 3,766,072 is a developer composition with at least two types of particles, one of which is the specific styrene butadiene copolymer resin designated, Pliolite S 5-D.

Additionally, there is illustrated in U.S. Pat. No. 3,590,000 developer compositions comprised of a polyester resin, and in U.S. Pat. No. 3,900,588 developer compositions having incorporated therein minor amounts of polymeric additives, and minor amounts of abrasive materials such as colloidal silica. In U.S. Pat. No. 3,983,045, there are disclosed developer compositions wherein the toner resin particles contain solid friction reducing materials, such as zinc stearate, and nonsmearable abrasive materials, such as colloidal silica. Also, in U.S. Pat. No. 3,853,778, there is described for incorporation into toner compositions materials with an amorphous backbone and side chain crystallinity. More specifically, this patent illustrates a developer composition wherein the toner particles are comprised of a polymer selected from crystalline homopolymers, or copolymers with an amorphous backbone and side chain crystallinity derived from the polymerization of a polymerizable mixture with a polymerizable monomer having a crystalline side alkyl group therein.

It is indicated in the '778 patent that several different types of thermoplastic resins are presently used in toner particles, and while they are generally capable of producing good quality images these materials have certain deficiencies in specific areas. For example, when the toner composition is to be used on a combustible surface such as paper, some of the toners selected for fusing at a temperature which will enable sufficient adherence of the resin particles to the surface can result in charring, or burning thereof. Also, according to the disclosure of this patent, several toner resins have a very low fusing temperature causing them to be tacky at ordinarily encountered conditions, resulting in undesirable caking, or agglomeration of these particles during storage. The temperature at which caking or agglomeration occurs with a given resin is referred to as the blocking temperature for that material. Conventional toner resin materials are characterized by a blocking temperature substantially lower than the fusing temperature. Thus, a toner material having a blocking temperature substantially above the temperature normally encountered during storage, also has a high fusing temperature thereby requiring an excessively large quantity of heat energy to fuse the toner material to the copy substrate. When a high melting toner is selected for conventional xerographic apparatuses, either lower operating speeds, or larger fusers are required in order to adequately fix the deposited toner image. The heat generated by high output fusers endangers sensitive machine parts, such as selenium photoreceptors, and also can elevate room temperature to the discomfort of the machine operators. Further, in flash fusing these toner compositions are known to emit undesirable effluents, causing pollution hazards. The toner compositions of the present invention overcome many of these disadvantages.

As further indicated in the '778 patent, it is rather difficult and costly to manufacture thermoplastic resins having consistently uniform molecular weights, resulting in polymers that normally possess nonuniform melting ranges, and consequently fusing temperatures cannot in all instances be accurately predicted. Accordingly, the fusing devices selected, as indicated herein, are generally of larger then ordinary capacities. Since the temperature in the fuser should not be maintained above the char point of the paper, often it is necessary to reduce the speed at which the paper passes through the fuser unit of automatic xerographic duplicating machines. Thus, it would be desirable to formulate a toner with a balanced combination of blocking temperature, and fusing temperature, and further a toner wherein there is a desirable drop in a melt viscosity above the melting point of the toner resin particles. The toner composition of the present invention satisfies these objectives.

Moreover, there is a need for toner, and developer compositions which are simultaneously hard and tough since, for example, soft toner compositions tend to form undesirable films on reuseable photoconductive imaging members. These films which have different electrical characteristics than the photoconductive member and are hygroscopic, adversely effect the electrical conductivity of the imaging member when the imaging apparatus is operated under conditions of high humidity. However, a polymeric material which is too tough is undesirable from the standpoint of its resistance to attrition, such as by jet pulverization procedures. Also, the polymers which are hard and brittle tend to fracture when impinging upon each other, or on relatively hard machine surfaces forming undesirable fine abrasive dust particles in the toner handling apparatus, and these particles may drift in air and cause premature wearing of various machine components.

Attempts have been directed to obtaining toner resins from crystalline materials, as these polymer materials are known to melt rather sharply, rather than over a broad melting range, however, the available crystalline polymers are relatively conductive, and moreover do not generally possess a sharp decrease in the melt viscosity above the melting point of the resin. Further, many of these resins do not possess in combination desirable sharp melting points within a specific temperature interval, low polymer melt viscosity, a sharp decrease in the melt viscosity above the melting point of the toner resin, good wetting characteristics, and flow properties during fusing. The toner compositions of the present invention satisfy many of these objectives.

SUMMARY OF THE INVENTION

It is an object of the present invention to provide toner compositions, and developer compositions, with thermotropic liquid crystalline polymers, which overcome many of the above-noted disadvantages.

In another object of the present invention there are provided polycarbonate and copolycarbonate thermotropic liquid crystalline polymers of desirable characteristics, including a substantial decrease in the melt viscosity at the clearing point of the polymer.

In another object of the present invention there are provided thermotropic liquid crystalline polyurethanes, polyesters and copolyesters of desirable characteristics, including a decrease in the melt viscosity at the clearing point of these polymers.

In yet a further object of the present invention there are provided toner and developer compositions containing therein thermotropic liquid crystalline polycarbonates, copolycarbonates, polyurethanes, polyesters and copolyesters, and wherein these compositions possess low polymer melt viscosity, desirable minimum fix temperatures, narrow melting temperature intervals, and wherein there is a decrease in the melt viscosity above the melting point at the clearing point of the toner resin particles.

In yet another object of the present invention there are provided toner and developer compositions useful in flash fusing systems, which compositions also have excellent flow properties during fusing, and desirable wetting characteristics, and are comprised of thermotropic liquid crystalline polycarbonates, copolycarbonates, polyurethanes, polyesters and copolyesters.

In a further object of the present invention there are provided toner compositions that possess low polymer melt viscosity, desirable minimum fix temperatures, narrow melting temperature intervals, and wherein there is a decrease in the melt viscosity above the melting point of the toner resin particles, providing marking of high optical density, and enabling matte finishes.

In an additional object of the present invention there are provided toner resin macromolecules with two different types of structures in their backbone, in an alternating sequence, namely a high rigid aromatic structure, and a soft aliphatic structure.

It is yet an additional object of the present invention to provide methods for developing electrostatographic images with toner compositions comprised of thermotropic liquid crystalline copolycarbonates, polyurethanes, polyesters and copolyesters, enabling a decrease in the melt viscosity at the clearing temperature of these polymers.

These and other objects of the present invention are accomplished by providing developer compositions, and toner compositions having incorporated therein thermotropic liquid crystalline polymers. More specifically, in one embodiment the present invention is directed to toner and developer compositions wherein the toner composition is comprised of thermotropic liquid crystalline polymers, pigment particles, and optional charge control agents, inclusive of those illustrated in U.S. Pat. No. 4,298,672, the disclosure of which is totally incorporated herein by reference. In a preferred embodiment of the present invention the toner compositions are comprised of those substances selected from the group consisting of thermotropic liquid crystalline polycarbonates, and copolycarbonates, thermotropic liquid crystalline polyurethanes, and thermotropic liquid crystalline polyesters, and copolyesters. Toner compositions have incorporated therein these polymers possessing the desirable characteristics disclosed hereinbefore, including a narrow melting temperature interval, a decrease in the melt viscosity above the melting point at the clearing point of the polymer resinous particles, desirable minimum fix temperature, excellent flowability, desirable wetting characteristics.

The thermotropic liquid crystalline polymers disclosed herein exhibit a mesophase in the melt state at temperatures above the melting temperature, and prior to the formation of an isotropic melt. Differential Scanning Calorimetry (DSC) thermograms of these polymers indicate two transitions, that is a (1) transition from a crystalline solid state to a liquid crystalline phase (melting temperature); and (2) transition from a liquid crystalline state to isotropic melt (clearing temperature). Also, rheological properties of the thermotropic liquid crystalline polymers of the present invention illustrate that the melt viscosity of these polymers in the liquid crystalline state is a strong function of shear rate (FIG. 1*a*), and that the melt viscosity decreases 3 to 4 orders of magnitude at the clearing temperature (FIG. 1*b*).

More specifically, there is illustrated in FIG. 1*a* the viscosity in poises versus the frequency in radons per second for the thermotropic liquid crystalline polycarbonate of Example I. This graph indicates that the melt viscosity of the liquid crystalline polycarbonate of Example I decreases substantially with shear rate.

Figure 1B:
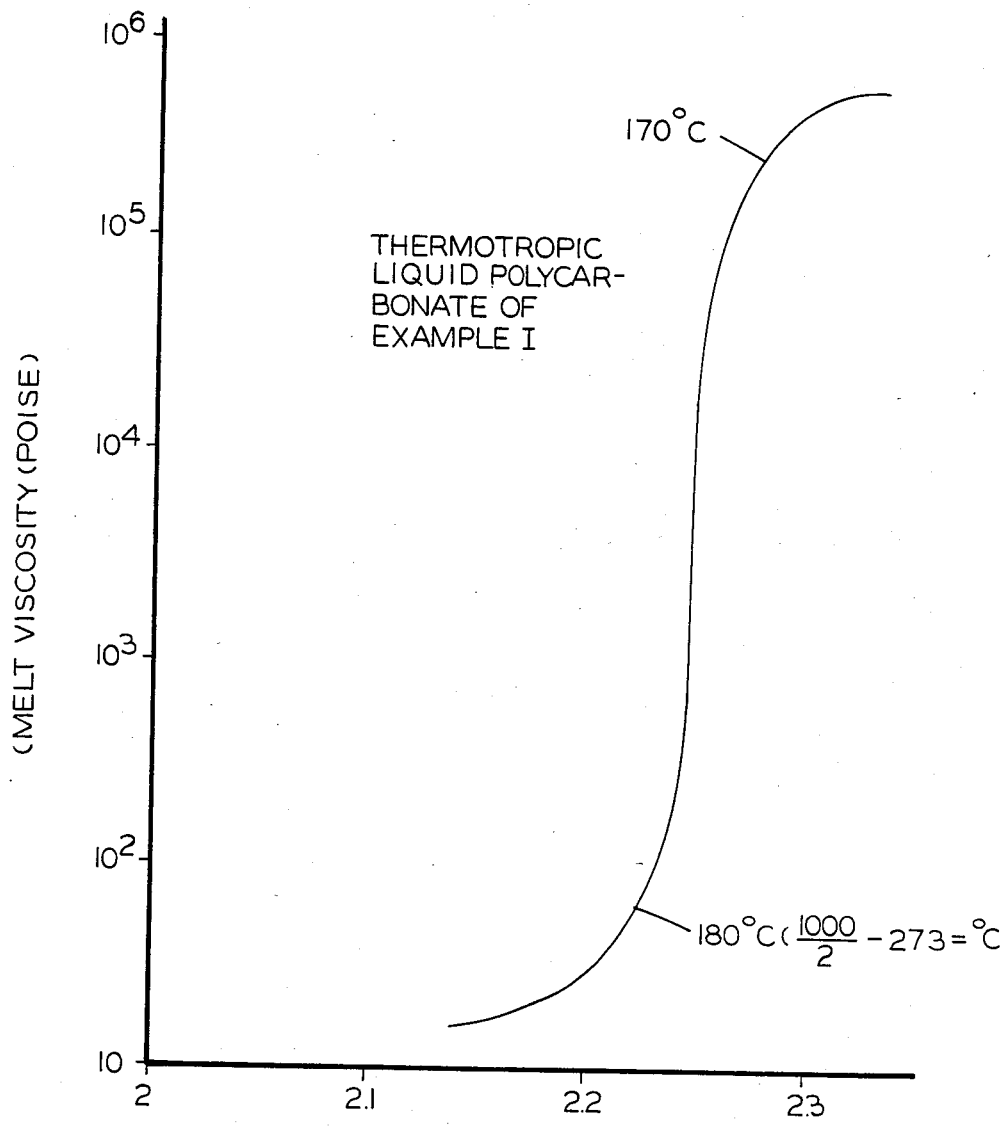

There is illustrated in FIG. 1*b* a line graph detailing the melt viscosity in poises as a function of the temperature in degrees Centigrade. The numbers 2 to 2.3 are converted into degrees Centigrade by dividing this number into 1,000 to arrive at the temperature in Kelvin, and subsequently there is subtracted from the result 273. Therefore, for the thermotropic liquid crystalline polycarbonate of Example I there is a substantial decrease in the melt viscosity for a 10 degree temperature interval of 180° C. to 170° C.

The thermotropic liquid crystalline polymers of the present invention are prepared in a manner so as to control the rigidity of the macromolecules backbone for the purpose of promoting thermotropic liquid crystalline behavior, and allowing for the melting and clearing points to be above a certain minimum temperature, that is above the specific toner blocking temperature, which is for example about 55° to about 60° C., but not higher than about 100° to 180° C. These macromolecules are designed enabling two different types of structure in their backbone in an alternating sequence, for example, a highly rigid aromatic structure which aids in the imparting of the thermotropic liquid crystalline characteristics, and a soft aliphatic segment imparting the desired viscosity and behavior.

Examples of thermotropic liquid crystalline polymeric materials included within the scope of the present invention are those selected from the group consisting of the following formulas:

I. Thermotropic liquid crystalline polycarbonates $$\left[O-(Ar)_1-O-\overset{\overset{\displaystyle O}{\|}}{C}-O-R-O-\overset{\overset{\displaystyle O}{\|}}{C}\right]_x$$

where $(Ar)_1$ is selected from the group consisting of

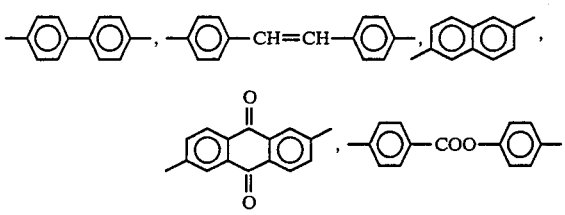

R is selected from the group consisting of $(CH_2)_n$, $-(CH_2)_2-O-(CH_2)_2-$, and $(CH_2)_2-O-(CH_2)_2-O-(CH_2)_2-$ with n being a number of from about 4 to about 12; and x represents the degree of polymerization. More specifically, x can be a number of from about 5 to about 1,000.

II. Thermotropic liquid crystalline copolycarbonates $$\left[O-(Ar)_1-O-\overset{\overset{\displaystyle O}{\|}}{C}-O-R-O-\overset{\overset{\displaystyle O}{\|}}{C}\right]_x\left[O(Ar)_2-O-\overset{\overset{\displaystyle O}{\|}}{C}-O-R-O-\overset{\overset{\displaystyle O}{\|}}{C}\right]_y$$

wherein R, $(Ar)_1$, x and y are as defined herein, and $(Ar)_2$ is selected from the group consisting of

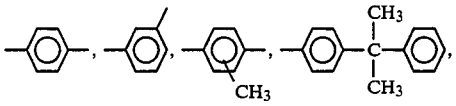

and

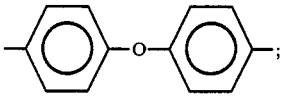

III. Thermotropic liquid crystalline polyurethanes $$\left[NH-(Ar)_1-NH-\overset{\overset{\displaystyle O}{\|}}{C}-O-R-O-\overset{\overset{\displaystyle O}{\|}}{C}\right]_x$$

where $(Ar)_1$ and R are as defined herein, x represents the degree of polymerization. More specifically, x can be a number of from about 5 to about 1,000;

IV. Thermotropic liquid crystalline polyesters $$\left[O-(Ar)_1-O-\overset{\overset{\displaystyle O}{\|}}{C}-R-\overset{\overset{\displaystyle O}{\|}}{C}\right]_x$$

where $(Ar)_1$ and R are as defined herein, x represents the degree of polymerization. More specifically, x can be a number of from about 5 to about 1,000; and V. Thermotropic liquid crystalline copolyesters $$\left[O-(Ar)_1-O-\overset{\overset{\displaystyle O}{\|}}{C}-R-\overset{\overset{\displaystyle O}{\|}}{C}\right]_x\left[O-(Ar)_2-O-\overset{\overset{\displaystyle O}{\|}}{C}-R-\overset{\overset{\displaystyle O}{\|}}{C}\right]_y$$

where $(Ar)_1$, $(Ar)_2$ and R are as defined herein, x and y represent respectively the number of repeating units in the macromolecule. More specifically, x and y can be any number between about 5 and about 1,000.

These polymers are highly useful for incorporation into toner compositions in that they possess a narrow melting temperature interval of from about 80° to about 280° C., and preferably from about 100° to about 180° C. More specifically, with regard to the copolycarbonates the melting temperature interval is from about 125° to about 180° C., while the melting temperature interval for the liquid crystalline polyurethanes is from about 150° to about 180° C., the melting temperature interval for the liquid crystalline polyesters is from about 175° to about 220° C., the melting temperature interval for the liquid crystalline copolyesters is from 110° to 200° C., and the melting temperature interval for the polycarbonates is from about 140° C. to about 260° C.

Of primary importance with respect to the liquid crystalline polymers illustrated is the property enabling the melt viscosity of these polymers to decrease at the clearing point. More specifically, the melt viscosity of the polymers illustrated herein are from about 10 poises to about 100 poises while the melting points thereof are from about 80° C. to about 260° C. The melt viscosity of the thermotropic liquid crystalline materials of the present invention decreases from $10^4$ to $10^5$ poise to about 10 to 100 poise at the clearing temperature and this significant decrease occurs within an interval of a few degrees centigrade, that is from about 2° to about 10° C. A drop in melt viscosity in this manner is deemed to be critical insofar as enabling the use of low fusing energy and providing images of high optical density. With respect to the clearing point, it is generally from about 5° C. to about 25° C. above the melting point of these polymers.

Various suitable colorants and/or pigments particles may be admixed with any of the thermotropic liquid crystalline polymers of the present invention including carbon black, Nigrosine dye, magnetic particles such as Mapico Black, comprised of a mixture of iron oxides, chrome yellow, ultramarine blue, DuPont oil red, phthalocyanine blue, and the like. The pigment particles are present in the toner composition in sufficient quantites so as to render it highly colored, thus enabling the formation of visible images on the photoresponsive imaging member. Thus, for example, where conventional xerographic copies of documents are desired, the pigment particles are preferably carbon black, present in the toner composition in an amount of from about 3 percent by weight to about 20 percent by weight, and preferably from about 4 percent by weight to about 12 percent by weight. With regard to magnetic pigments such as Mapico Black, they are generally incorporated into the toner composition in an amount of from about 10 percent by weight to about 60 percent by weight, and preferably from about 20 percent by weight to about 30 percent by weight.

When the pigment particles are comprised of magnetites, that is a mixture of iron oxides ($FeO.Fe_2O_3$) including those commercially available as Mapico Black, they are present in the toner composition in an amount of from about 10 percent by weight to about 70 percent by weight, and preferably in an amount of from about 20 percent by weight to about 50 percent by weight.

Also included within the scope of the present invention are colored developer compositions comprised of the thermotropic liquid toner resin particles, and carrier particles, and as pigments or colorants, magenta, cyan, and/or yellow particles, as well as mixtures thereof. More specifically, with regard to the production of color images utilizing a thermotropic developer composition, illustrative examples of magenta materials that may be selected as pigments include, for example, 2,9-dimethyl-substituted quinacridone and anthraquinone dye identified in the color index as Cl 60710, Cl Dispersed Red 15, a diazo dye identified in the color index as Cl 26050, Cl Solvent Red 19, and the like. Illustrative examples of cyan materials that may be used as pigments include copper tetra-4(octadecyl sulfonamido)phthalocyanine, X-copper phthalocyanine pigment listed in the color index as Cl 74160, Cl Pigment Blue, and Anthrathrene Blue, identified in the color index as Cl 69810, Special Blue X-2137, and the like; while illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron yellow SE/GLN, Cl dispersed yellow 33, 2,5-dimethoxy-4-sulfonanilide phenylazo-4'-chloro-2,5-dimethoxy acetoacetanilide, permanent yellow FGL, and the like.

These pigments, namely cyan, magenta, and yellow are generally present in the toner composition in an amount of from about 1 weight percent to about 15 weight percent based on the weight of the toner resin particles.

Illustrative examples of carrier materials that can be selected for mixing with the toner particles of the present invention include those substances that are capable of triboelectrically obtaining a charge of opposite polarity to that of the toner particles. Accordingly, the carrier particles of the present invention are selected so as to be of a negative, or positive polarity enabling the toner particles that are positively, or negatively charged to adhere to and surround the carrier particles. Specific examples of carriers are granular zircon, granular silicon, methyl methacrylate, glass, steel, nickel, iron ferrites, silicon dioxide, and the like. Additionally, there can be selected as carrier particles nickel berry carriers as disclosed in U.S. Pat. No. 3,847,604, the disclosure of which is totally incorporated herein by reference, comprised of nodular carrier beads of nickel, characterized by surfaces of reoccurring recesses and protrusions thereby providing particles with a relatively large external area.

The selected carrier particles can be used with or without a coating, the coating generally being comprised of fluoropolymers, such as polyvinylidenefluoride resins, terpolymers of styrene, methylmethacrylate, and a silane, inclusive of triethoxy silane, tetrafluoroethylenes, and the like.

The diameter of the carrier particles can vary, generally however it is from about 50 microns to about 1,000 microns, allowing these particles to possess sufficient density and inertia to void adherence to the electrostatic images during the development process. The carrier particles can be mixed with the toner particles in various suitable combinations, however, best results are obtained when about 1 part per toner to about 10 parts to about 200 parts by weight of carrier are mixed.

The toner compositions of the present invention can be prepared by a number of known methods including melt blending the toner resin particles, pigment particles or colorants, followed by mechanical attrition, extrusion processing, and other similar methods such as spray drying, melt dispersion, direct dispersion polymerization, and direct suspension polymerization. In one method, a solvent dispersion of the resin particles and the pigment particles and spray dried under controlled conditions to result in the desired product.

The thermotropic liquid crystalline polymers of the present invention are generally prepared by polycondensation reactions. Thus, for example, the thermotropic liquid crystalline polycarbonate polymer can be prepared by the low temperature solution polycondensation of p,p'-biphenol, with a series of aliphatic bischloroformates. These reactions are effected in the presence of an acid acceptor, such as triethylamine, with an organic solvent. The reaction temperature is from about 10° C. to about 30° C., and preferably from about 15° C. to about 25° C. More specifically, the polycarbonates are prepared by reacting from about 0.8 moles to about 1 mole of p,p'-biphenol, with from about 0.7 moles to about 1 mole of an aliphatic bischloroformate, at a temperature of from about 15° to about 30° C. This reaction is effected in the presence of an acid acceptor, including triethylamine, pyridine and the like, and organic solvents such as methylene chloride. Thereafter, the resulting product is separated from the reaction mixture by known techniques, washed if desired, and identified by various analytical tools including elementary analysis, NMR, IR and UV. The polyester and polyurethane liquid crystalline polymers are prepared in a similar manner. More specifically, these polymers are prepared, for example, by interfacial or melt polycondensations.

There results polymers with intrinsic viscosities of from about 0.06 to about 0.75, and preferably from about 0.1 to about 0.2 deciliter per gram (dl/g).

The synthesis of a specific thermotropic liquid crystalline polymer is illustrated with reference to the following equations:

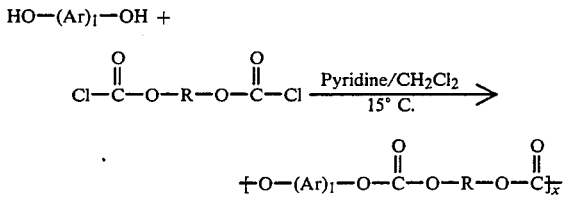

wherein $(Ar)_1$, R, and x are as defined herein.

The thermotropic liquid crystalline polymers of the present invention provide very useful low melting free flowing toners, which melt within a range of less than 10° C. as determined, for example, by a thermomechanical analyzer (TMA), and further the toners disclosed herein are sharp melting and exhibit rapid changes in melt viscosity with temperature, a desirable property which results from the liquid crystalline structure of the polymers disclosed. Moreover, although the polymers are crystalline at the melting point, they do not have a high undesirable charge decay rate, and are not highly conductive, and thus are capable of being useful for the development of latent images of high quality and high optical image density.

The toner and developer compositions of the present invention may be selected for use in developing images in electrostatographic imaging systems, containing therein photoreceptors, illustrative examples of which include layered photoresponsive imaging members comprised of transport layers and photogenerating layers, reference U.S. Pat. No. 4,265,990, the disclosure of which is totally incorporated herein by reference, and selenium, or selenium alloys. Examples of generating layers include trigonal selenium, metal phthalocyanines, metal free phthalocyanines and vanadyl phthalocyanines, while examples of charge transport layers include the diamines as disclosed in U.S. Pat. No. 4,265,990. Other photoresponsive devices useful in the present invention include polyvinylcarbazole 4-dimethylaminobenzylidene, benzhydrazide; 2-benzylideneamino-carbazole, 4-dimethylaminobenzylidene, (2-nitro-benzylidene)-p-bromoaniline; 2,4-diphenylquinazoline; 1,2,4-triazine; 1,5-diphenyl-3-methyl pyrazoline 2-(4'-dimethyl-aminophenyl)-benzoaxzole; 3-amino-carbazole, polyvinyl carbazole-trinitrofluorenone charge transfer complex; and mixtures thereof.

The following examples are being supplied to further define specific embodiments of the present invention, it being noted that these examples are intended to illustrate and not limit the scope of the present invention. Parts and percentages are by weight unless otherwise indicated.

EXAMPLE I

There was charged in a 250 milliliter, 4 necked round bottom flask equipped with a mechanical stirrer, a nitrogen inlet and outlet, a thermometer, and a liquid dropping funnel, 11.2 grams, 0.06 moles of p,p'biphenol, 18 grams of triethylamine, and 100 milliliters of methylene chloride. The flask was placed in cooled water, and mechanical agitation of the contents was accomplished for 15 minutes. When the internal temperture of the flask decreased to 15° C., the dropping funnel was filled with 0.055 to 0.06 moles of diethylene glycol bischloroformate, which was added to the reaction mixture in 0.5 hours. Thereafter, the reaction mixture was stirred for an additional 3 hours while maintaining the temperature at 20° to 25° C.

After cooling to room temperature, the resulting polymer was separated from the reaction mixture by filtration, and subsequently the product obtained was washed, first with 100 milliliters of hydrochloric acid, and then 3 times with 100 milliliters of deionized water. Thereafter, the polymer solution was separated, and the polymer product was precipitated in methanol, followed by drying in a vacuum oven at 80° C.

There was obtained as evidenced by elemental analysis, and infrared spectroscopy, the product biphenoldiethylene glycol polycarbonate in a yield of 99.5 percent. Thereafter, this product was characterized with DSC, TMA, thermal mechanical analysis, TGA, thermal gravometric analysis, Rheometric Mechanical Spectrometer analysis, X-Ray diffraction, and optical microscopy.

The DSC thermograms of this polymer indicated a melting point transition from the crystalline solid state to the liquid crystalline state of from 150° C. to 180° C., and a clearing temperature transition from the liquid crystalline state to the isotropic melt of from 160° C. to 180° C. Moreover, the TGA results indicate that this polymer was totally stable up to 320° C. Rheological properties as determined with the Rheometric Mechanical Spectrometer, evidenced that the melt viscosity of the polycarbonate prepared in accordance with the procedure of this example decreases slowly initially with increasing temperature, and thereafter decrea es 3 to 4 orders of magnitude at the clearing temperature. Specifically for the biphenoldiethylene glycol polycarbonate of this example, the melt viscosity thereof decreases from $2\times10^5$ poise to 20 poise at 185° C. This behavior was not observed with similar conventional polymers.

Other polycarbonates can be prepared in a similar manner by substituting for the diethylene glycol bischloroformate, various different chloroformates including dipropylene glycol bischloroformate. There thus can be obtained products of the following formula:

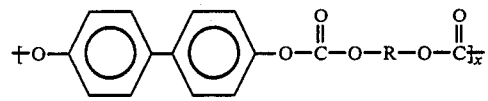

wherein R is derivable from bischloroformate selected, and x represents the degree of polymerization. The TGA results show that these polymers are also thermally stable up to 320° C.

There was then formulated by extrusion processing a negative charging toner with 20 percent by weight of Mapico black based on the weight of the toner composition and 80 percent by weight of the above prepared diethylene polycarbonate, and extrusion and micronization of this composition was effected without any difficulties. Thereafter the black colored toner particles with an average particle diameter of about 11 microns were mixed with a carrier consisting of a ferrite core coated with a terpolymer of styrene, methylmethacrylate, and vinyl triethoxy silane. About 3 parts of the toner composition were mixed with 100 parts of carrier. Thereafter this mixture was cascaded across a selenium photoconductive surface containing thereon an electrostatic latent image, and the toner deposited on the selenium surface in image configuration. The image was then electrostatically transferred to a paper receiving sheet, and this sheet was then pulsed under a Xenon flash lamp generating 1.1 microsecond light pulses. There was used an inclined Xenon flash tube apparatus which yields an energy distribution as a function of position in the range of 0.4 to 1.5 Joules/cm$^2$. The image which consisted of a line of rectangles 1 millimeter wide and 3 millimeters high was flash fused. Subsequently, a scotch tape was applied on the fused image with a gentle finger pressure, the tape was then slowly peeled off at an angle of 180°. The image optical densities, after fusing, and subsequent to the scotch tape test, were measured by a microdensitometer. In order to determine the fusing energy, optical density changes before and after the scotch tape test were compared. Fusing energy is then defined as the energy at which image optical density changed by 0.1 before and after the scotch tape test. The optical density de-enhancement was obtained by comparing the optical density before and after fusing.

These measurements indicated that the toner composition with the biphenoldiethylene glycol polycarbonate were thermally stable and that very little odor or effluent was detected at very high energy levels, and wherein the density de-enhancement was less than 0.1, the fusing energy was significantly low, 0.7 joules/cm$^2$, and there was generated subsequent to fusing a matte image.

Moreover, the melting temperature of the polycarbonate polymer, as well as other polymers included within the scope of the present invention can be further reduced by partially substituting the reactant p,p' biphenyl with hydroquinone, bisphenol A, methylhydroquinone, or resorcinol.

EXAMPLE II

There was charged in a 250 milliliter, 4 necked round bottom flask equipped with a mechanical stirrer, a nitrogen inlet and outlet, a thermometer, and liquid dropping funnel 11.2 to 7.6 grams, 0.06 to 0.04 moles of p,p' biphenol, up to 2.1 grams hydroquinone, 18 grams of triethylamine and 100 ml of methylene chloride. The flask was placed in cooled water, and mechanical agitation of the contents was accomplished for 15 minutes. When the internal temperature of the flask dropped to 15° C., the dropping funnel was filled with 0.055 to 0.06 mole of diethylene glycol bischloroformate, which was added to the reaction mixture in 0.5 hours. Thereafter, the reaction mixture was stirred for an additional 3 hours while being maintained at a temperature of 20° to 25° C.

On completion of the reaction, the resulting polymer solution was washed first with 100 milliliters of hydrochloric acid (IN), and then 3 times with 100 milliliters of deionized water. Thereafter, the polymer solution was separated and precipitated in hexane, followed by drying in a vacuum oven at 50° C.

There resulted in a yield of 99 percent, as determined by elemental analysis and infrared spectroscopy, copolycarbonate products of the formula

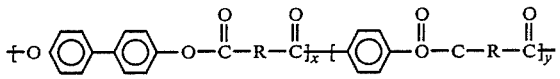

wherein R is a diethylene glycol, x and y represents the fractions of the two repeating units in the copolymers. These copolymers had melting temperatures of from 137° C. to 170° C., depending on their molecular weight.

These polymers were further characterized by repeating the procedure of Example I, and substantially similar results were obtained. Toner compositions were prepared with these copolycarbonates by repeating the procedure of Example I and subsequent to flash fusing substantially similar results were obtained.

EXAMPLE III

There was charged in a 250 milliliter, 4 necked round bottom flask equipped with a mechanical stirrer, a nitrogen inlet and outlet, a thermometer, and liquid dropping funnel 7.5 to 11.2 grams, 0.04 to 0.06 moles of p,p' biphenol, up to 2.4 grams of methylhydroquinone, 18 grams of triethylamine and 100 milliliters of methylene chloride. The flask was placed in cooled water, and mechanical agitation of the contents was accomplished for 15 minutes, when the internal temperature of the flask dropped to 15° C. the dropping funnel was filled with 0.055 to 0.06 mole of diethylene glycol bischloroformate, which was added to the reaction mixture in 0.5 hours. Thereafter, the reaction mixture was stirred for an additional 3 hours while the mixture was maintained at a temperature of 20° to 25° C.

On completion of reaction, the resulting polymer solution was washed first with 100 milliliters of hydrochloric acid (IN), and then 3 times with 100 milliliters of deionized water. Thereafter, the polymer solution was separated and precipitated in hexane, followed by drying in a vacuum oven at 50° C.

There resulted in 99 percent yield, as determined by elemental analysis, and infrared spectroscopy, copolycarbonate thermotropic polymers of the following formula

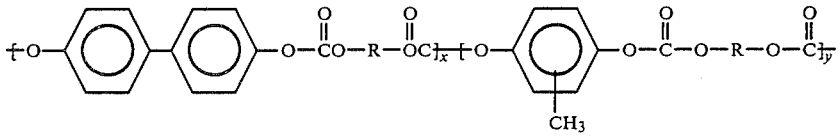

wherein R is diethylene glycol, and x and y are as defined in Example II. These polymers have melting temperatures of from 125° C. to 170° C. depending on their molecular weight.

The polymers obtained were also further characterized by repeating the procedure of Example I and substantially similar results were generated.

Thereafter, toner compositions were prepared with this polymer by repeating the procedure of Example I, and subsequent to the flash fusing evaluation substantially similar results were obtained.

EXAMPLE IV

There was charged in a 250 milliliter, 4 necked round bottom flask equipped with a mechanical stirrer, a nitrogen inlet and outlet, a thermometer, and liquid dropping funnel 8.8 to 11.2 grams, 0.047 to 0.06 mole of p,p' biphenol, up to 2.8 grams of bisphenol A, 18 grams of triethylamine and 100 ml of methylene chloride. The flask was placed in cooled water, and mechanical agitation of the content was accomplished for 15 minutes, when the internal temperature of the flask dropped to 15° C. the dropping funnel was filled with 0.055 to 0.06 mole of diethylene glycol bischloroformate, which was added to the reaction mixture in 0.5 hours. Thereafter, the reaction mixture was stirred for an additional 3 hours while the mixture was maintained at a temperature of 20° and 25° C.

On completion of reaction, the resulting polymer solution was washed first with 100 milliliters of hydrochloric acid (IN), and then 3 times with 100 milliliters of deionized water. Thereafter, the polymer solution was separated and precipitated in hexane, followed by drying in a vacuum oven at 50° C.

There resulted in 99 percent yield, as confirmed by elemental analysis and infrared spectroscopy, copolycarbonates of the following formula

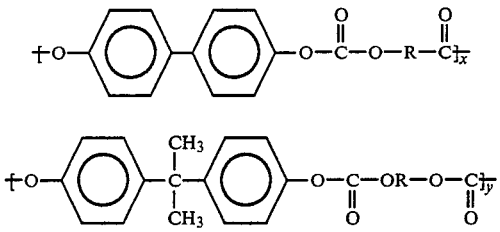

wherein R is diethylene glycol and x and y represent the fraction of the two repeating units in the copolymer, that is a number of from 5 to 1,000.

These polymers were further characterized by repeating the procedure of Example I with substantially similar results.

Toner composition can be prepared by repeating the procedure of Example I and subsequent to the flash fusing evaluations substantially similar results would be obtained.

EXAMPLE V

There was charged in a 250 milliliter, 4 necked round bottom flask equipped with a mechanical stirrer, a nitrogen inlet and outlet, a thermometer, and liquid dropping funnel 9.3 grams, 0.05 moles of p,p' biphenol, 18 grams of triethylamine and 100 milliliters of methylene chloride. The flask was placed in cooled water, and mechanical agitation of the contents was accomplished for 15 minutes, when the internal temperature of the flask dropped to 15° C. the dropping funnel was filled with 0.045 to 0.05 mole of the aliphatic diacid chloride alezaic diacid chloride, which was added to the reaction mixture in 0.5 hours. Thereafter, the reaction mixture was stirred for an additional 3 hours while the mixture was maintained at a temperature of 20° to 25° C.

On completion of reaction, the resulting polymer solution was washed first with 100 milliliters of hydrochloric acid (IN), and then 3 times with 100 milliliters of deionized water. Thereafter, the polymer solution was separated and precipitated in hexane, followed by drying in a vacuum oven at 50° C.

There was obtained in a 90 percent yield, as confirmed by elemental analysis, and infrared spectroscopy, polyesters of the following formula

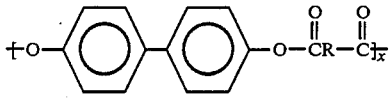

wherein R is the group $(CH_2)_7$, and x is as defined herein. Moreover, these polymers had melting point temperatures of 190° C. to 250° C., depending on their molecular weight.

These polymers can be further characterized by repeating the procedure of Example I.

Toner compositions can be prepared by repeating the procedure of Example I.

Other polyester thermotropic substances can be prepared with the exception that there is selected different aliphatic diacid chlorides such as sebacoyl chloride, $(CH_2)_8$ and the like including those chlorides with a carbon chain length of from about two carbons $(CH_2)_2$, to about 10 carbon atoms $(CH_2)_{10}$. Additionally, there can be selected as a reactant other dihydroxy biphenols, including triphenols in place of the p,p' biphenol.

EXAMPLE VI

There was charged in a 250 milliliter, 4 necked round bottom flask equipped with a mechanical stirrer, a nitrogen inlet and outlet, a thermometer, and liquid dropping funnel 5.58 to 9.3 grams, 0.03 to 0.05 moles of p,p' biphenol, 1.1 milliliters hydroquinone, 18 grams of triethylamine and 100 milliliters of methylene chloride. The flask was placed in cooled water, and mechanical agitation of the content was accomplished for 15 minutes, when the internal temperature of the flask dropped to 15° C. the dropping funnel was filled with 0.055 to 0.05 mole of azelaoyl chloride which was added to the reaction mixture in 0.5 hours. Thereafter, the reaction mixture was stirred for an additional 3 hours while the mixture was maintained at a temperature of 20° to 25° C.

On completion of the reaction, the resulting polymer solution was washed first with 100 milliliters of hydrochloric acid (IN), and then 3 times with 100 milliliters of deionized water. Thereafter, the polymer solution was separated and precipitated in hexane, followed by drying in a vacuum oven at 50° C.

There resulted in 99 percent yield, melting temperature of 170° C. to 195° C., a copolyester of the following formula

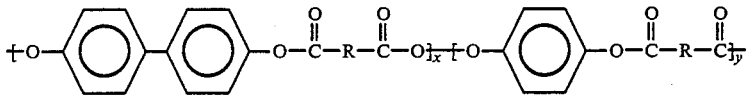

wherein R is the group $(CH_2)_7$ and x and y are as defined herein, that is they represent fractions of the two repeating units in the copolymer.

These polymers can be characterized by repeating the procedure of Example I.

Also, toner compositions can be prepared by repeating the procedure of Example I and subsequent to the flash fusing evaluations, substantially similar results were achieved.

EXAMPLE VII

There was charged in a 250 milliliter, 4 necked round bottom flask equipped with a mechanical stirrer, a nitrogen inlet and outlet, a thermometer, and liquid dropping funnel 5.58 to 9.3 grams, 0.03 to 0.05 moles of p,p' biphenol, up to 2.56 grams of methylhydroquinone, 18 grams of triethylamine and 100 milliliters of methylene chloride. The flask was placed in cooled water, and mechanical agitation of the content was accomplished for 15 minutes, when the internal temperature of the flask dropped to 15° C. the dropping funnel was filled with 0.045 to 0.05 mole of azelaoyl chloride, which was added to the reaction mixture in 0.5 hours. Thereafter, the reaction mixture was stirred for an additional 3 hours while the mixture was maintained at a temperature of 20° to 25° C.

On completion of the reaction, the resulting polymer solution was washed first with 100 milliliters of hydrochloric acid (IN), and then 3 times with 100 milliliters of deionized water. Thereafter, the polymer solution was separated and precipitated in hexane, followed by drying in a vacuum oven at 50° C.

There resulted in 90 percent yield, with a melting temperature of 155° C. to 220° C. the copolyester of the following formula as confirmed by elemental analysis and infrared spectroscopy

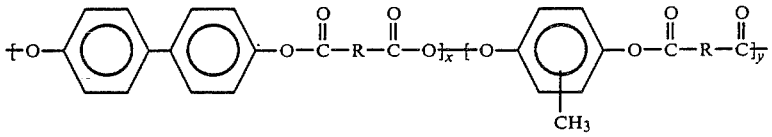

wherein R is $(CH_2)_7$ and x and y represent the fraction of the two repeating units in the copolymer.

This polymer was then characterized by repeating the procedure of Example I and substantially similar results were obtained.

A toner composition was then prepared by repeating the procedure of Example I, and subsequent to the flash fusing evaluation, substantially similar results were achieved.

EXAMPLE VIII

There was charged in a 250 milliliter, 4 necked round bottom flask equipped with a mechanical stirrer, a nitrogen inlet and outlet, a thermometer, and liquid dropping funnel 5.6 to 9.3 grams, 0.031 to 0.05 moles of p,p' biphenol, up to 4.3 grams of bisphenol A, 18 grams of triethylamine and 100 milliliters of methylene chloride. The flask was placed in cooled water, and mechanical agitation of the content was accomplished for 15 minutes, when the internal temperature of the flask dropped to 15° C. the dropping funnel was filled with 0.045 to 0.05 mole of azelaoyl chloride which was added to the reaction mixture in 0.5 hours. Thereafter, the reaction mixture was stirred for an additional 3 hours while the mixture was maintained at a temperature of 20° to 25° C.

On completion of the reaction, the resulting polymer solution was washed first with 100 milliliters of hydrochloric acid (IN), and then 3 times with 100 milliliters of deionized water. Thereafter, the polymer solution was separated and precipitated in hexane, followed by drying in a vacuum oven at 50° C.

There resulted in 99 percent yield, melting temperature 160° C. to 200° C., a copolyester of the following formula, as confirmed by elemental analysis and infrared spectroscopy

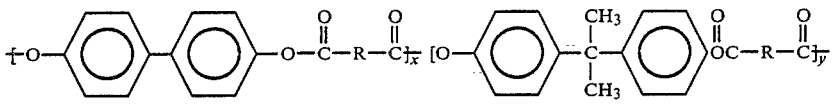

wherein R is $(CH_2)_7$ and x and y represent fractions of the two repeating units in the copolymer.

The polymer was further characterized by repeating the procedure of Example I with substantially similar results.

A toner composition was prepared by repeating the procedure of Example I, and subsequent to the flash fusing evaluations substantially similar results were achieved.

Other modifications of the present invention will occur to those skilled in the art based upon a reading of the present disclosure. These are intended to be included within the scope of this invention.

We claim:

1. An improved toner composition comprised of resin particles selected from the group consisting of thermotropic liquid crystalline polycarbonates, copolycarbonates, polyurethanes, polyesters, and copolyesters, and pigment particles.

2. An improved toner composition in accordance with claim 1 wherein there is further included therein charge enhancing compounds.

3. A toner composition in accordance with claim 1 wherein the resin is a thermotropic liquid crystalline polycarbonate.

4. A toner composition in accordance with claim 1 wherein the resin is a thermotropic liquid crystalline copolycarbonate.

5. A toner composition in accordance with claim 1 wherein the resin is a thermotropic liquid crystalline polyurethane.

6. A toner composition in accordance with claim 1 wherein the resin is a thermotropic liquiid crystalline polyester.

7. A toner composition in accordance with claim 1 wherein the resin is a thermotropic liquid crystalline copolyester.

8. A toner composition in accordance with claim 1 wherein the polycarbonate is of the formula

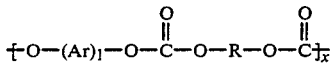

where $(Ar)_1$ is selected from the group consisting of

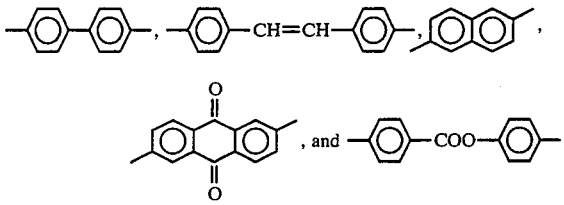

R is selected from the group consisting of $(CH_2)_n$, $-(CH_2)_2-O-(CH_2)_2-$, and $-(CH_2)_2-O-(CH_2)_2-O-(CH_2)_2-$ with n being a number of from about 4 to about 12, and x represents the degree of polymerization.

9. A toner composition in accordance with claim 1 wherein thermotropic liquid crystalline copolycarbonate is

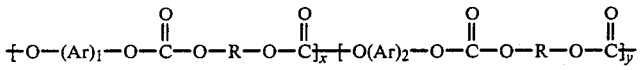

where $(Ar)_1$ is selected from the group consisting of

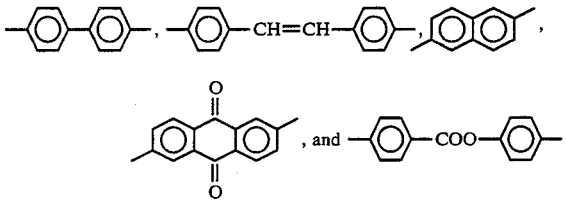

R is selected from the group consisting of $(CH_2)_n$, $-(CH_2)_2-O-(CH_2)_2-$, and $-(CH_2)_2-O-(CH_2)_2-O-(CH_2)_2-$ and $(Ar)_2$ is selected from the group consisting of

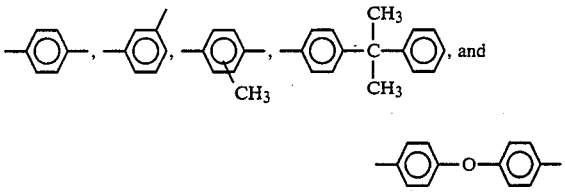

with n being a number of from about 4 to 12, and x and y represent the fraction of the two repeating units.

10. A toner composition in accordance with claim 1 wherein the thermotropic liquid crystalline polyurethane is

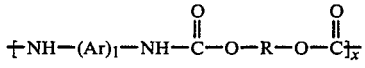

where $(Ar)_1$ is selected from the group consisting of

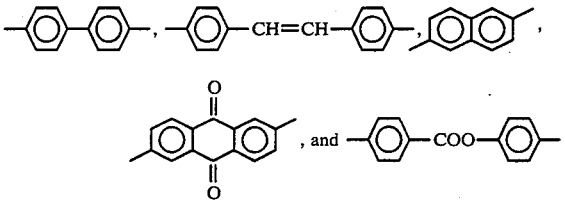

R is selected from the group consisting of $(CH_2)_n$, $-(CH_2)_2-O-(CH_2)_2-$, and $-(CH_2)_2-O-(CH_2)_2-O-(CH_2)_2-$, n is a number of from about 4 to about 12, and x represents the degree of polymerization.

11. A toner composition in accordance with claim 1 wherein the thermotropic liquid crystalline polyester is

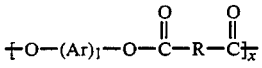

where $(Ar)_1$ is selected from the group consisting of

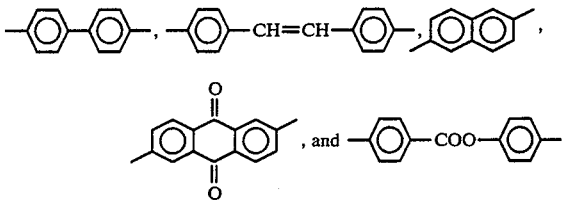

and R is selected from the group consisting of $(CH_2)_n$, $-(CH_2)_2-O-(CH_2)_2-$, and $-(CH_2)_2-O-(CH_2)_2-O-(CH_2)_2-$, n is a number of from about 4 to about 12, and x represents the degree of polymerization.

12. A toner composition in accordance with claim 1 wherein the thermotropic liquid crystalline copolyester is

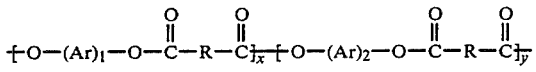

where $(Ar)_1$ is selected from the group consisting of

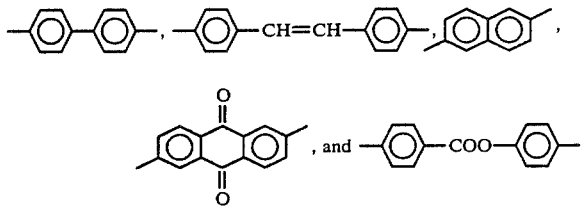

R is selected from the group consisting of $(CH_2)_n$, $-(CH_2)_2-O-(CH_2)_2-$, and $-(CH_2)_2-O-(CH_2)_2-O-(CH_2)_2-$, $(Ar)_2$ is selected from the group consisting of

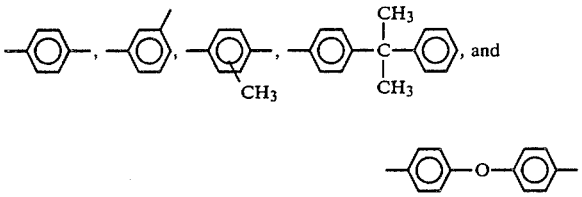

with n being a number of from about 4 to 12, and x and y represent the fraction of the two repeating units.

13. A toner composition in accordance with claim 1 wherein the liquid crystalline polycarbonate results from the condensation reaction of p,p' biphenol and aliphatic bischloroformates.

14. A toner composition in accordance with claim 1 wherein the liquid crystalline copolycarbonate results from the condensation reaction of p,p' biphenol, hydroquinone, methylhydroquinone, resorcinol, resorcinol A and aliphatic bischloroformates.

15. A toner composition in accordance with claim 1 wherein the resulting toner composition has a melting temperature of from about 120° C. to about 200° C.

16. A toner composition in accordance with claim 1 wherein the melt viscosity of the resulting toner composition decreases from about $10^4$ poise to about 10 poise at clearing temperature of the toner particles, this clearing point being from about 120° C. to about 200° C.

17. A toner composition in accordance with claim 1 wherein the melt viscosity of the toner resin at clearing temperature is from about 10 poise to about 100 poise.

18. A developer composition comprised of the toner composition of claim 1 and carrier particles.

19. A developer composition in accordance with claim 18 wherein the carrier particles consist of a steel core coated with a polymeric resinous material.

20. A method for developing latent images which comprises forming an electrostatic latent image on a photoconductive imaging member, contacting the image with the toner composition of claim 1, followed by transferring the image to a suitable substrate, and optionally permanently affixing the image thereto.

21. A method of imaging in accordance with claim 20 wherein the image is fixed at a fusing energy from about 0.65 $J/cm^2$ to about 0.8 $J/cm^2$.

22. A method of imaging in accordance with claim 20 wherein the thermotropic liquid crystalline polymer is a copolycarbonate.

23. A method of imaging in accordance with claim 20 wherein the thermotropic liquid crystalline polymer is a polyurethane.

24. A method of imaging in accordance with claim 20 wherein the thermotropic liquid crystalline polymer is a polyester.

25. A toner composition in accordance with claim 8 wherein x is a number of from about 5 to about 1,000.

26. A toner composition in accordance with claim 9 wherein x and y are numbers of from about 5 to about 1,000.

27. A toner composition in accordance with claim 10 wherein x and y are numbers of from about 5 to about 1,000.

28. A toner composition in accordance with claim 11 wherein x and y are numbers of from about 5 to about 1,000.

* * * * *